US006109721A

United States Patent [19]

Kim

[11] Patent Number: 6,109,721

[45] Date of Patent: Aug. 29, 2000

[54] ALIGNMENT SYSTEM AND PROCESS OF AUTOMATICALLY CONTROLLING BIDIRECTIONAL PRINTING POSITION OF PRINTHEAD IN A SERIAL PRINTER

[75] Inventor: Dong-Hun Kim, Anyang, Rep. of Korea

[73] Assignee: SamSung Electronics Co., Ltd., Suwon, Rep. of Korea

[21] Appl. No.: 08/879,858

[22] Filed: Jun. 20, 1997

[30] Foreign Application Priority Data

Jun. 20, 1996 [KR] Rep. of Korea ..... 96-22584

[51] Int. Cl.[7] ..... B41J 29/393

[52] U.S. Cl. ..... 347/19

[58] Field of Search ..... 347/19, 81, 14, 347/16

[56] References Cited

U.S. PATENT DOCUMENTS

| | | | |
|---|---|---|---|
| 4,435,674 | 3/1984 | Hevenor et al. | 347/19 |
| 4,675,696 | 6/1987 | Suzuki | 347/19 |
| 5,101,473 | 3/1992 | Kotaki . | |
| 5,250,956 | 10/1993 | Haselby et al. . | |
| 5,297,017 | 3/1994 | Haselby et al. . | |
| 5,350,929 | 9/1994 | Meyer et al. . | |
| 5,404,020 | 4/1995 | Cobbs . | |
| 5,422,575 | 6/1995 | Ferrer et al. . | |
| 5,448,269 | 9/1995 | Beauchamp et al. . | |
| 5,451,990 | 9/1995 | Sorenson et al. . | |
| 5,480,240 | 1/1996 | Bolash et al. . | |
| 5,600,350 | 2/1997 | Cobbs et al. . | |

*Primary Examiner*—John Barlow
*Assistant Examiner*—Charles W. Stewart, Jr.
*Attorney, Agent, or Firm*—Robert E. Bushnell, Esq.

[57] ABSTRACT

A bidirectional print position alignment system for automatically aligning bidirectional printing position of a printhead in a serial printer as a function of high sensor accuracy and clock frequency of a CPU controlling the sensor. The alignment system includes a sensing section for sensing a position of a printhead for vertical alignment, a misalignment detecting section for detecting mechanical misalignment of the printhead, and a printing section for correcting said mechanical misalignment of the printhead and printing information on a printable medium after said mechanical misalignment of the printhead is corrected. Since the vertical alignment operation according to the present invention is dependent upon sensor stability and clock accuracy instead of the user's visual confirmation, the accuracy in setting of a print position of the printhead can be realized and the printing quality can be enhanced.

17 Claims, 7 Drawing Sheets

ALIGNMENT SYSTEM AND PROCESS OF AUTOMATICALLY CONTROLLING BIDIRECTIONAL PRINTING POSITION OF PRINTHEAD IN A SERIAL PRINTER

CLAIM FOR PRIORITY

This application makes reference to, incorporates the same herein, and claims all benefits accruing under 35 U.S.C. §119 from an application for *APPARATUS AND METHOD FOR AUTOMATICALLY CONTROLLING THE BIDIRECTIONAL PRINTING POSITION IN A SERIAL PRINTER* earlier filed in the Korean Industrial Property Office on Jun. 20, 1996, and there duly assigned Serial No. 22584/1996.

BACKGROUND OF THE INVENTION

1. Technical Field

The present invention relates to printers, and particularly relates to an alignment system and techniques for vertical alignment of a printhead cartridge performing bidirectional printing in a serial printer.

2. Related Art

Conventional printer such as a dot matrix printer, inkjet printer and plotter includes a printhead having an array of nozzles mounted on a carriage for printing a plurality of rows of dots in a single scan of a movable print carriage across a printable medium. Typical printers print information serially one letter per unit time and can be unidirectional or bidirectional. Bidirectional printers can print information on a printable medium in both directions, that is, from left to right of a first row, and then from right to left of a second row next to the first row. As a result, a printing speed of a bidirectional printer is twice as fast as that of a unidirectional printer which can only print information in one direction and has a carriage which must be returned to a starting position for each row.

A printhead is typically mounted in a print cartridge within an assembly which is mounted on the carriage of the printer/plotter. Generally, full color or black and white printing or plotting requires that the carriage supporting the printhead be precisely aligned so as to begin printing information on a printable medium in each scan axis direction. Otherwise, any misalignment of the carriage will result in a misregistration of print images, particularly when the printer is a multi-color type of printer. Unfortunately however, mechanical misalignment of the carriage in the printable scan axis (i.e., x-axis) and in the carriage scan axis (i.e., y-axis) is common in conventional printers.

Conventional techniques for alignment of printhead of typical printers are disclosed, for example, in U.S. Pat. No. 5,600,350 for *Multiple Inkjet Print Cartridge Alignment By Scanning A Reference Pattern And Sampling Same With Reference To A Position Encoder* issued to Cobbs et al., U.S. Pat. No. 5,448,269 for *Multiple Inkjet Print Cartridge Alignment For Bidirectional Printing By Scanning A Reference Pattern*issued to Beauchamp et al., U.S. Pat. No. 5,451,990 for *Reference Pattern For Use In Aligning Multiple Inkjet Cartridge* issued to Sorenson et al., U.S. Pat. No. 5,404,020 for *Phase Plate Design For Aligning Multiple Inkjet Cartridges By Scanning A Reference Pattern* issued to Cobbs, U.S. Pat. No. 5,350,929 for *Alignment System For Multiple Color Pen Cartridges* issued to Meyer et al., U.S. Pat. No. 5,297,017 for *Print Cartridge Alignment In Paper Axis* issued to Haselby et al., and U.S. Pat. No. 5,250,956 for *Print Cartridge Bidirectional Alignment In Cartridge Axis* issued to Haselby et al., in which software is incorporated into the printer for permitting a user to perform vertical and horizontal alignment of a printing position of a printhead via a predetermined test pattern. A series of vertical and horizontal test line segments is utilized by the user to perform vertical and horizontal alignment operations of the print cartridge. The user's visual confirmation is required when the printhead is aligned with respect to the test line segments. Since the user is required to confirm alignment operation, I have observed that the accuracy of such an alignment cannot be trusted. In addition, extra time and effort are required to align accurate vertical lines for bidirectional printing.

SUMMARY OF THE INVENTION

Accordingly, it is therefore an object of the present invention to provide an alignment system of a printer for automatically controlling a print position of a printhead.

It is also an object to provide an improved alignment system of a printer for efficiently aligning a print position of a carriage supporting a printhead for beginning printing information on a printable medium with a high accuracy.

It is another object to provide an improved alignment system of a printer for aligning a print position of a printhead on the basis of the stable operation of an optical sensor and accuracy of an internal clock signal in lieu of the user's visual confirmation.

These and other objects of the present invention can be achieved by a bidirectional print position alignment system for automatically controlling bidirectional printing position of a printhead in a serial printer. The print position alignment system comprises a sensing section for sensing a position of a printhead for vertical alignment, a misalignment detecting section for detecting mechanical misalignment of the printhead, and a printing section for correcting the mechanical misalignment of the printhead and printing information on a printable medium after the mechanical misalignment of the printhead is corrected. The sensing section includes an optical emitter for transmitting an optical signal an optical receptor for sensing the optical signal transmitted from the optical emitter to determine the position of the printhead for vertical alignment.

The misalignment correction section according to the present invention includes a transport unit for moving and stopping movement of the carriage bidirectionally in a print axis; a first processing unit for storing a head fire position HFP where the optical signal is first sensed by the optical receptor as the carriage moves toward the optical receptor, and storing a fine time delay count FTD value; a second processing unit for storing a head fire position HFP where the optically signal is secondly sensed by the optical receptor as the carriage moves reversely toward, the optical receptor, and storing a fire time delay count FTD value; and a position difference determining unit for determining a value of the position difference of the printhead sensed by the sensing unit.

The first processing unit includes an adjacent position determination unit for determining whether the carriage has arrived at the head fire position HFP corresponding to a first adjacent position; a counter operating unit for initializing a fire time delay FTD counter when the carriage has arrived at the first adjacent position and starting operation of the fire time delay FTD counter; a head fire position increase determination unit for determining whether a count value of the fire time delay FTD counter exceeds a head fire position HFP value; a sensing determination unit for determining whether the optical signal has been sensed by the sensing wing when the head fire position HFP value has not increased as a result of the head fire position value increase determination; and a storing unit for storing the head fire position HFP where the optical signal has been sensed when the optical signal has been sensed by the sensing wing as a result of the sensing determination, and for storing the fire time delay FTD count.

The transport unit includes a return position determination unit for determining whether the carriage has arrived at the head fire position HFP corresponding to a return position, a moving unit for moving the carriage reversely when the carriage has arrived at the return position as a result of the return position determination, a start position determining unit for determining whether the carriage has arrived at the head fire position HFP, and a stopping unit for stopping the carriage when the carriage has arrived at the start position as a result of the start position determination.

The second processing unit includes an adjacent position determination unit for determining whether the carriage has arrived at the head fire position HFP corresponding to a second adjacent position; a counter operating unit for initializing a fire time delay FTD counter when the carriage has arrived at the second adjacent position as a result of the adjacent position determination and starting operation of the fire time delay FTD counter; a head fire position HFP value increase determination unit for determining whether the value of the fire time delay FTD counter exceeds the head fire position HFP value; a sensing determination unit for determining whether the optical signal has been sensed by the sensing wing when the fire position value has not increased as a result of the head fire position HFP value increase determination; and a storing unit for storing the head fire position HFP where the optical signal has been sensed by the sensing wing, and storing the fire time delay FTD count.

The printing section according to the present invention includes a clock generating unit for generating a clock signal to adjust the synchronism of the serial printer; a print start signal generating unit for generating a print start signal by determining a print position in compliance with the head fire position HFP value calculated using the clock signal; an enable signal generating unit for generating an enable signal by determining a print time upon a predetermined printing position in compliance with the difference of the fire time delay FTD calculated using the clock signal; and a printing unit for performing printing operation delayed as much as a mechanical error value obtained from comparing the print start signal with the enable signal.

In accordance with another aspect of the present invention, a bidirectional print position alignment method for automatically controlling bidirectional print position of a printhead in a printer includes a first moving step for moving a printhead, a first processing step for storing a head fire position HFP where the printhead has been first sensed by a sensing unit and storing a fire time delay FTD count, a second moving step for moving the printhead reversely; a second processing step for storing the head fire position HFP where the printhead has been secondly sensed by the sensing unit and storing the fire time delay FTD count, a stopping step for stopping the travel of the printhead; a position difference operating step for calculating the position difference value of the printhead sensed by the sensing unit; and a printing step for shift-printing as much as the difference value.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
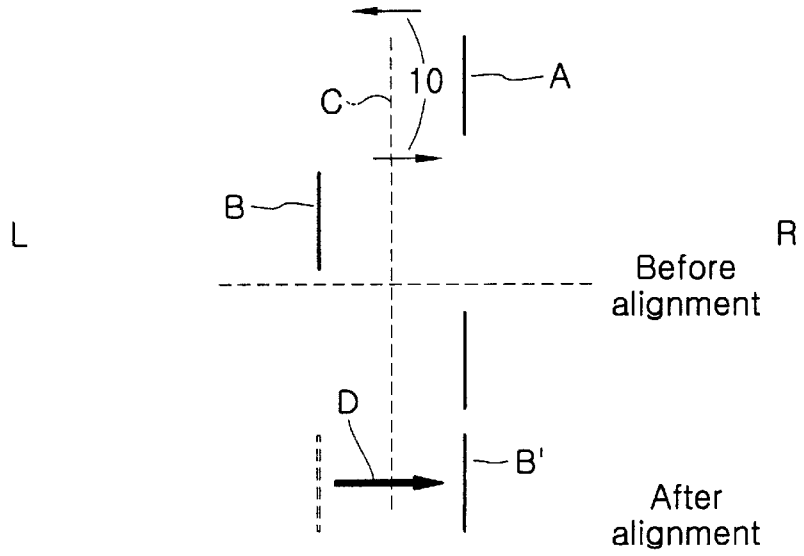
FIG. 1 illustrates actual printing position of a printhead and mechanical misalignment before vertical alignment via software, and printing position of a printhead after vertical alignment via software.

Referring now to the drawings, FIG. 1 illustrates an actual printing position of a printhead and mechanical misalignment before vertical alignment via software, and printing position of a printhead after vertical alignment via software usable in a typical printer. As shown in FIG. 1, when a carriage supporting a printhead is moved from right to left, C indicates a printing position sensed by a central processing unit (CPU) of the printer system operating the printing software, and A indicates an actual printing position printed due to mechanical error. In a next row, when the carriage is moved from left to right, C indicates the printing position sensed by the CPU of the printer system operating the printing software, B indicates the position which is actually printed due to mechanical error, and D indicates the distance difference between the actual printing positions A and B. In addition, when the carriage is moved from left L to right R, B' indicates the printing position where a head fire time is delayed as much as the time period corresponding to the distance difference D of the actual printing positions A and B.

When aligning vertical lines for printing B by delaying as much as the distance difference D of the two actual printing positions A and B as shown in FIG. 1, the error of a horizontal printing position indicated when the bidirectional printing is corrected by the initial controlling when producing the printer and by using the vertical alignment controlling function. That is, the operation is performed in the following order.

Figure 2:
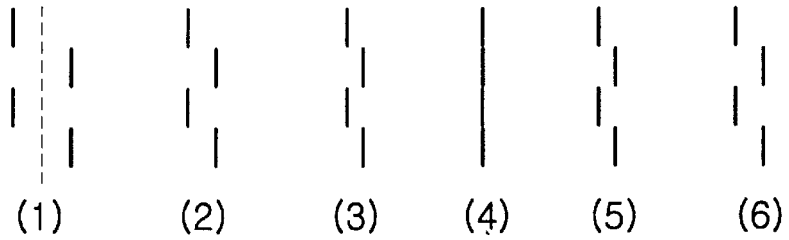
FIG. 2 illustrates a series of test print results for vertical alignment.

First, in order to obtain test print results for vertical alignment, the test print for vertical alignment is performed as shown in FIG. 2. Print results (1) to (6) are obtained through different vertical alignment values allocated by a printing aligning software. The vertical alignment is completed by selecting test print result (4), which has the most aligned vertical line from all the test print results (1) through (6). Here, the vertical alignment value indicates a value for compensating for the difference between the position of the actual mechanical driving unit due to mechanical error and the position sensed by the CPU of the printer system. By delaying the fire time of a printhead, the printing operation is performed. That is, when the user of the printer selects a number having the most aligned vertical line, the printer system converts a distance value corresponding to the distance difference D between the two actual print positions A and B as shown in FIG. 1 into a time value and delays the fire time of the printhead in order to achieve the aligning operation for printing purposes. Contemporary print position aligning techniques using software are, however, sensitive to interval of shift values between the actually selected number and its adjacent number. Since the printed results must be confirmed visually by the user, the accuracy of the vertical alignment cannot be trusted. In addition, extra time and efforts are required to align accurate vertical lines for bidirectional printing.

Figure 3:
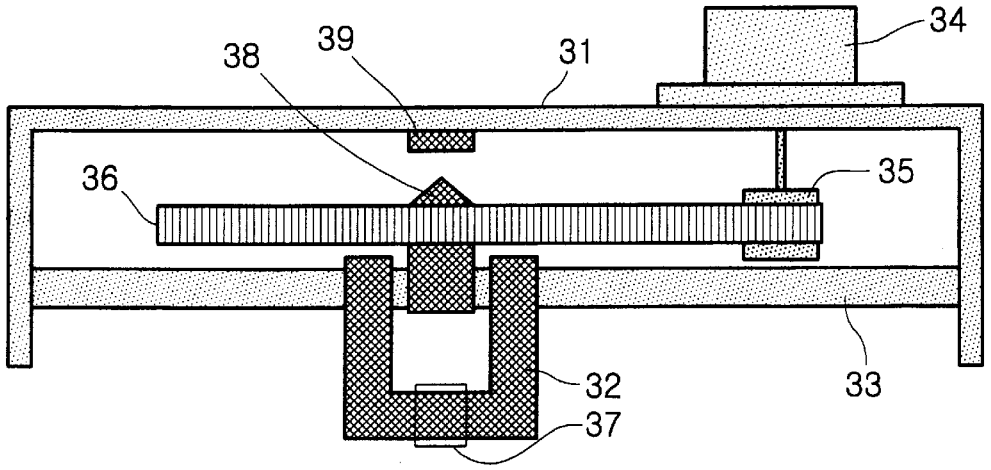
FIG. 3 is a sectional view of major mechanical components of a printer for aligning the operation of a printhead according to the principles of the present invention.

FIG. 3 illustrates major mechanical components of a printer according to the principles of the present invention. A carrier system of the printer includes a main frame 31, a carriage 32 which supports and moves an optical emitter 38 and printhead, a carrier shaft 33 which acts as a rail for moving the carriage 32, a carrier motor 34 which provides power for moving the carriage 32, a drive pulley 35 which carries the power provided by the carrier motor 34, a timing belt 36 which carries the power of drive pulley 35 to the carriage 32, a head port 37 which contains the printhead in the carriage 32, the optical emitter 38 which is provided on the carriage 32 to transmit an optical signal to the main frame 31, and an optical receptor 39 which senses the optical signal transmitted from the optical emitter 38.

Figure 4A:
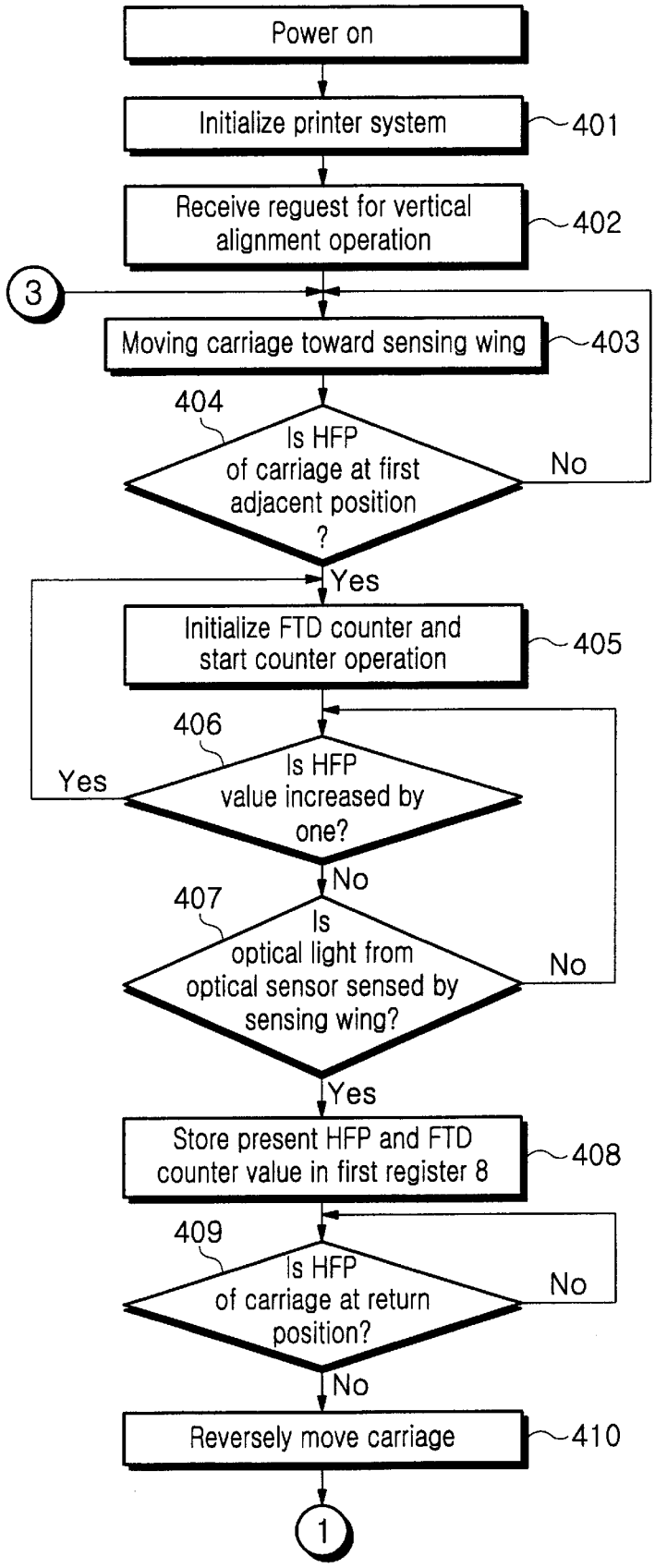
FIGS. 4A and 4B illustrate a vertical alignment process of bidirectional printing position of a printhead according to the principles of the present invention.
Figures 4, 4B:
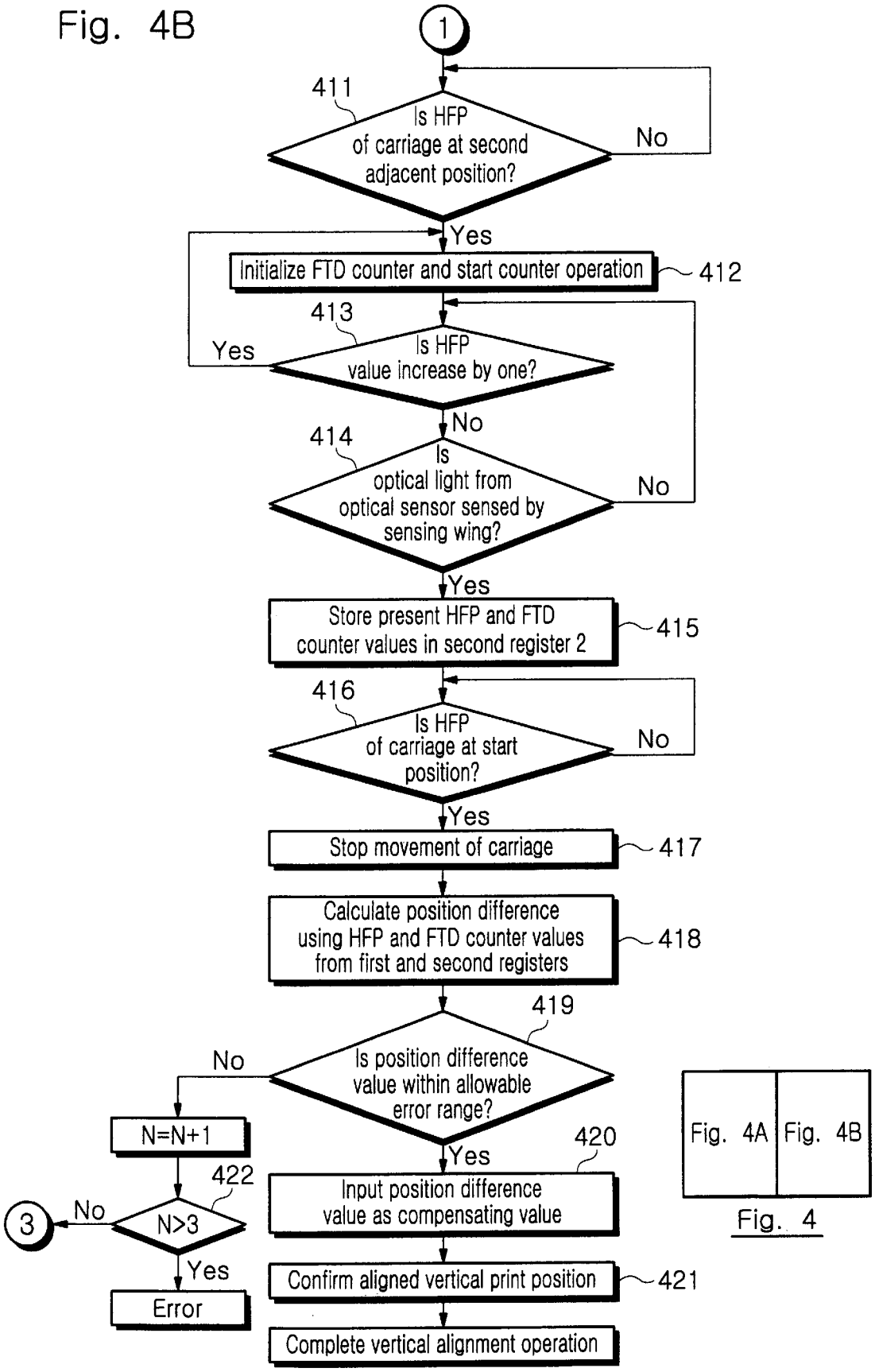

FIGS. 4A–4B illustrate a control process of aligning a bidirectional print position of a printhead in a serial printer according to the principles of the present invention. Generally, the control process includes a first moving step for moving a carriage 32 supporting a printhead, a first processing step for storing a head fire position HFP where the printhead is first sensed by the optical receptor 39 and storing a fire time delay FTD count, a second moving step for moving the printhead reversely, a second processing step for storing the head fire position HFP where the printhead is again sensed by the optical receptor 39 and storing the fire time delay FTD count, a stopping step for stopping movement of the printhead, a position difference calculating step for calculating the position difference value of the printhead sensed by the optical receptor 39, and a printing step for shift-printing as much as the difference value.

The first processing step includes an adjacent position determination step 404 for determining whether the printhead has arrived at the head fire position HFP corresponding to a first adjacent position, a counter operating step 405 for initializing the fire time delay FTD counter when the printhead has arrived at the first adjacent position and starting the operation of the FTD counter, a head fire position HFP value increase determination step 406 for determining whether the counter value of the fire time delay FTD exceeds the head fire position BFP value, a first repeating step for again performing the counter operating step 405 when the head fire position HFP value is increased as a result of the head fire position HFP value increase determination, a sensing determination step 407 for determining whether the printhead is sensed by the optical receptor 39 when the head fire position HFP value has not increased as a result of the head fire position HFP value increase determination, a second repeating step for again performing the head fire position HFP value increase determination step 406 when the printhead has not been sensed by the optical receptor 39 as a result of the sensing determination; a storing step 408 for storing the head fire position HFP where the signal has been sensed in the case that the signal has been sensed by the optical receptor 39 as a result of the sensing determination and storing the fire time delay FTD count in the memory.

A second moving step includes a return position determination step 409 for determining whether the printhead has arrived at the head fire position HFP corresponding to a return position, and a reverse step 410 for reversely moving the printhead when the printhead has arrived at the return position.

A second processing step includes an adjacent position determination step 411 for determining whether the printhead has arrived at the head fire position HFP corresponding to a second adjacent position, a counter operating step 412 for initializing the fire time delay FTD counter when the printhead has arrived at the second adjacent position as a result of the adjacent position determination and starting the operation of the FTD counter, a head fire position HFP value increase determination step 413 for determining whether the counter value exceeds the unit head fire position HFP value, a first repeat step for again performing the counter operating step 412 when the head fire position HFP value has increased as a result of the head fire position HFP value increase determination, a sensing determination step 414 for determining whether the printhead has been sensed by the optical receptor 39 when the head fire position HFP value has not increased as a result of the head fire position HFP value increase determination, a second repeat step for again performing the head fire position HFP value increase determination when the printhead has not been sensed by the optical receptor 39 as a result of the sensing determination, and a storing step 415 for storing the head fire position HFP where the signal has been sensed in the case that the signal has been sensed by the optical receptor 39 as a result of the sensing determination and storing the fire time delay FTD count in the memory.

A stopping step includes a start position determination step 416 for determining whether the printhead has arrived at the head fire position HFP corresponding to the start position, and a step 417 for stopping the movement of the printhead when the printhead has arrived at the start position as a result of the start position determination.

A printing step includes an allowable error determination step 419 for determining whether the differences of the head fire position HFP and the fire time delay FTD are within an allowable error range, a repeat step 422 for repeatedly performing the aligning operation when the differences are beyond the reach of the allowable error as a result of the allowable error determination, a printing step 420 for performing the shift-printing as much as the error value in the case that the differences are within the allowable error as a result of the allowable error determination, and a step 421 for conforming the printer position with the printable medium.

Figure 5:
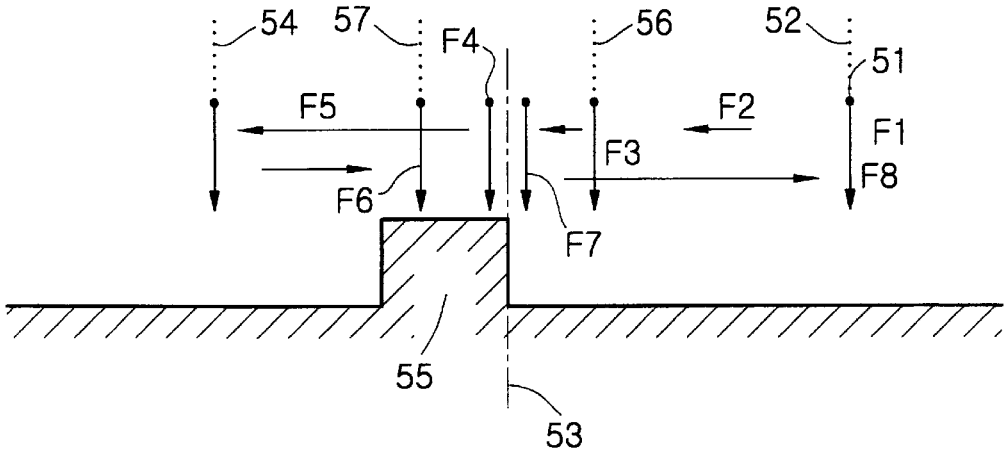
FIG. 5 illustrates a layout of the operating unit of the optical receptor.

FIG. 5 illustrates a layout of an operating unit of the optical receptor 39 which includes an optical emitter position 51 (●) for indicating a present position of an optical sensor 38, a waiting position 52 for indicating a print start position when the printer system is initialized, a standard position 53 for indicating the position printed by the CPU, first and second adjacent positions 56 and 57 which store a standard clock value (i.e., fire time delay FTD counter value) in a register in order to gain the minute fire time delay FTD value when the optical sensor 35 provided at the carriage 32 has arrived at the standard position 53 sensed by the CPU, a return position 54 for indicating the position where the carriage 32 has returned reversely after being moved for a predetermined distance, and a optical receptor 39 which receives the optical signal transmitted from the optical emitter 38 and transmits the results to the CPU. Here, positions F1 to F8 indicate the various positions of the optical emitter 38 provided at the carriage 32 during alignment operation.

Figure 6:
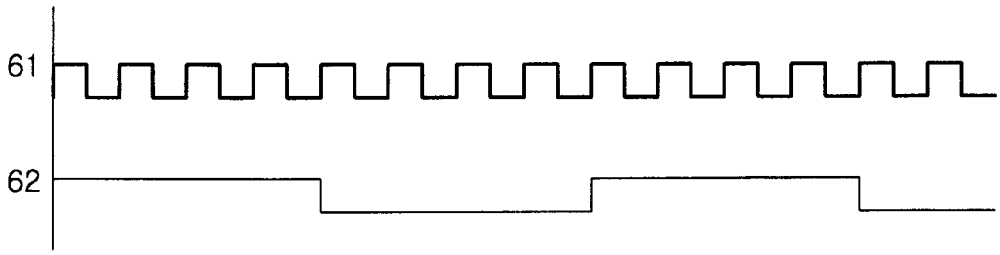
FIG. 6 is a timing chart of the position where a head fire position signal is located.

FIG. 6 is a timing chart of a head fire position HFP according to a standard clock frequency. A standard clock timing chart 61 indicates a fixed standard clock frequency provided by the printer system. A head fire position HFP signal timing chart 62 indicates a head fire position HFP signal generated by dividing the standard clock frequency. Here, the head fire position HFP signal is variable according to the speed of the carriage. For example, when the moving speed of the carriage is increased, the division ratio is also increased by multiplying the predetermined variable. Moreover, the head fire position HFP indicates the position where the printhead actually prints, and the fire time delay FTD indicates the actually printed position after the fire position is decided by using the standard clock as a basic unit.

The fire time delay FTD counter uses clock pulse of 10 MHz, i.e., 0.1 $\mu$s, and the head fire position HFP counter uses clock pulse of 10/32×1/62 MHz i.e., 198.4 $\mu$s by dividing the fire time delay FTD count into 32×62 according to the function of the printhead. The head fire position HFP value is counted when the operation of the printer system is performed and indicates the position of the printhead. Moreover, the fire time delay FTD counter is operated from the moment when the head fire position HFP counter value is the same as the number indicating the "adjacent position".

Now, the number of the fire time delay FTD count per the head fire position HFP can be obtained as follows.

Figure 8:
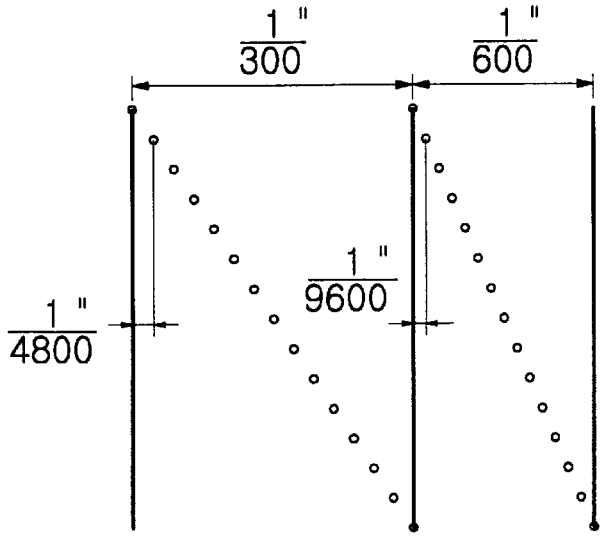
FIG. 8 is a conceptive diagram of a nozzles arrangement in a printhead having 300 DPI and 600 DPI.

As shown in FIG. 8, as 16 nozzles make one group and 48 nozzles make total three groups, the standard clock frequency per one nozzle is actually 1/16 of the actual standard clock frequency. Moreover, though the present printer system realizes (1/300)", i.e., 300 DPI (Dot Per Inch), the value in designing the system is set as ½ of the standard clock frequency, for realizing (1/600)", i.e., 600 DPI. Accordingly, the 32-division is obtained by ½×1/16. Here, the condition of 32-division indicates that the printhead is in an ideal state, and at this time, a printhead of 3.2 $\mu$s, i.e., 312.5 kHz is needed. However, as the real head is 5 kHz, the head fire period is sixty-two (62) times of the value, as illustrated in the following formula:

$$0.1\ \mu s \times 32 \times 62 = 198.4\ \mu s \text{ (that is, 5 kHz)}$$

Moreover, the standard clock frequency of the fire time delay FTD counter uses a value of 8-division, i.e., 0.8 $\mu$s considering the proper resolution. Accordingly, the number of the fire time delay FTD count per the head fire position HFP is 198.4/0.8=248.

Figure 7:
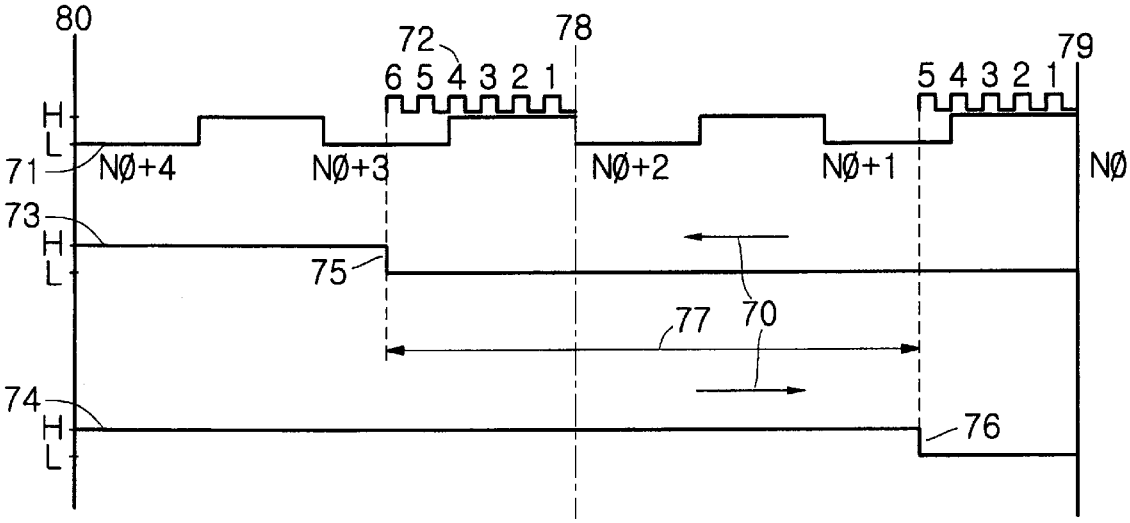
FIG. 7 is a timing chart of an aligning operation of the position difference according to the principles of the present invention.

FIG. 7 illustrates a timing chart showing the alignment the position difference. A head fire position HFP signal timing chart 71 is provided to indicate the head fire positions HFPs ($N\phi$ to $N\phi_{+4}$) between the adjacent positions 56 and 79, and the adjacent positions 57 and 80. A standard clock frequency 72 indicates the standard clock signal which one head fire position HFP has. A standard position 78 indicates the position printed by the CPU. A timing chart 73 is provided to indicate a position 75 where a optical receptor 39 senses the first optical sensor signal input. Likewise, a timing chart 74 is provided to indicate a position 76 where a optical receptor 39 senses the second optical sensor signal input. Mechanical error 77 indicates the difference between the position 75 sensing the first optical sensor signal input and the position 76 sensing the second optical sensor signal input by the optical receptor 39.

As shown in FIG. 7, the first optical sensor signal sensing position 75 is calculated by using the head fire position HFP signal 71 which the first optical sensor signal input is sensed and using the standard clock signal 72, i.e., the fire time delay FTD is indicated by adding the head fire position $N\phi_{+2}$ to the standard clock 6. The second optical sensor signal sensing position 76 is calculated by using the head fire position HFP signal 71 which the second optical sensor signal input is sensed and using the standard clock signal 72 is indicated by adding the head fire position $N\phi$ to the standard clock 5. The mechanical error value between the position 75 where the first optical sensor signal input is sensed and the position 76 where the second optical sensor signal input is sensed by the optical receptor 39 is calculated by adding the head fire position 2 to the standard clock 1. Accordingly, after calculating the minute value by dividing the position difference 77 generated by the mechanical error by the head fire position HFP unit and the standard clock unit, the printing position is aligned by delaying the printing time as much as the calculated value of the mechanical error ( i.e., the head fire position 2 and the standard clock 1), when the printing operation is actually performed.

Figure 11:
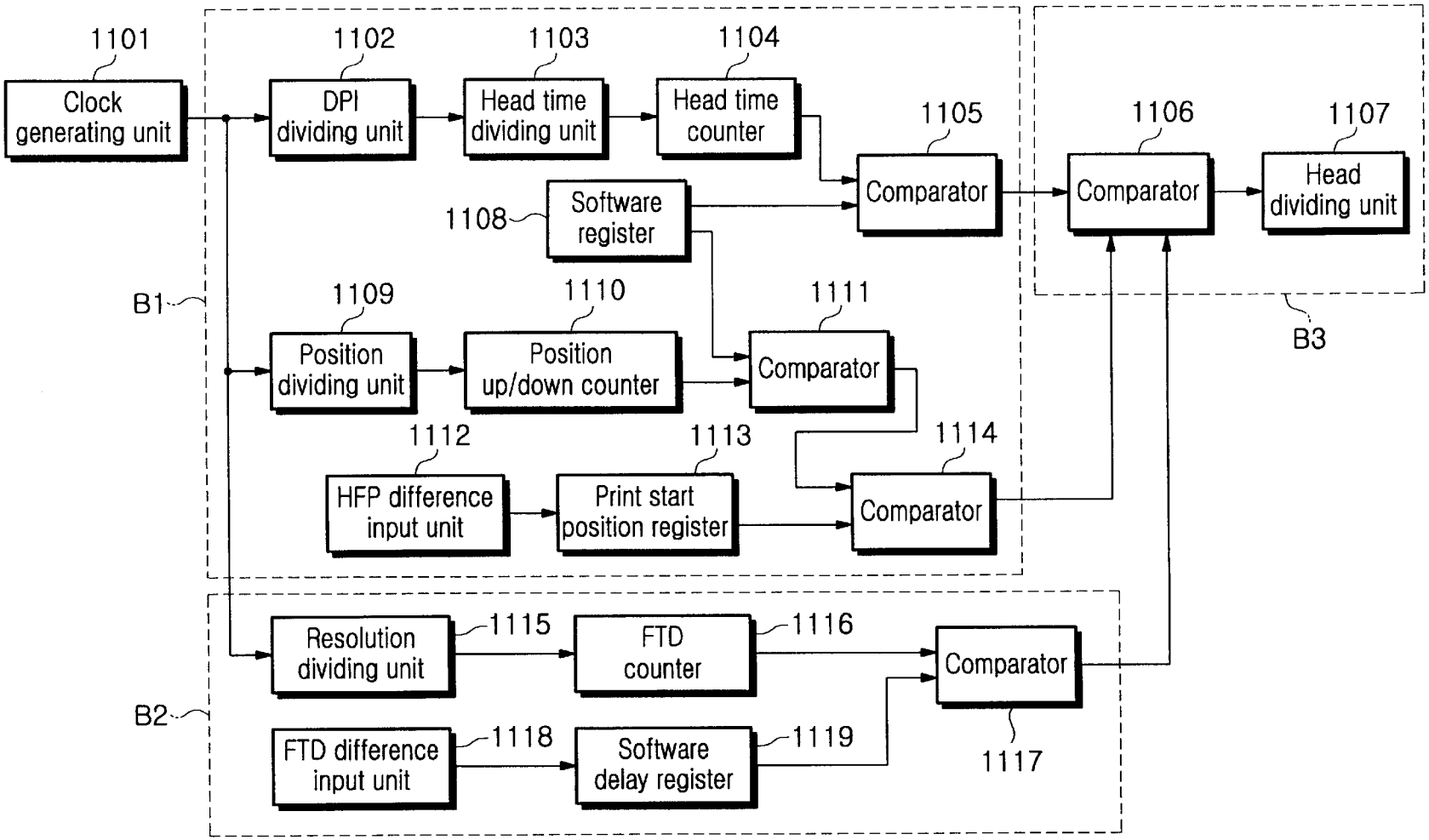
FIG. 11 is a block diagram of an alignment system for performing aligning operation of a printhead using mechanical error value according to the principles of the present invention.

FIG. 11 illustrates an alignment system of a printer constructed according to the principles of the present invention for performing vertical alignment operation using mechanical error value. As shown in FIG. 11, the alignment system of the printer includes a clock generating unit 1101 for generating a clock signal in order to adjust the synchronism of the serial printer system. A print start signal generating unit B1 is connected to the clock generating unit 1101 for generating a print start signal by determining the printing position in compliance with the head fire position HFP difference calculated using the clock signal generated by the clock generating unit 1101. An enable signal generating unit B2 is also connected to the clock generating unit 1101 for generating an enable signal by determining the printing position in compliance with the fire time delay FTD difference calculated using the clock signal generated by the clock generating unit 1101. A printing unit B3 is connected to the print start signal generating unit B1 and the enable signal generating unit B2 for performing the printing operation delayed as much as the calculated mechanical error by comparing the print start signal generated by the print start signal generating unit B1 with the enable signal generated by the enable signal generating unit B2.

Print start signal generating unit B1 includes a DPI dividing unit 1102 for dividing a clock signal according to the DPI supported by the serial printer system. A head time dividing unit 1103 divides again the clock signal divided from the DPI dividing unit 1102 to generate a standard clock frequency per one nozzle. A head time counter 1104 counts the head time based on the clock divided from the head time dividing unit 1103. A software register 1108 registers information on the function of the printhead. A comparator 1105 compares the value counted by the head time counter 1104 with the value stored in the software register 1108 to generate a head fire standard clock. A position dividing unit 1109 generates a clock for controlling operation of the motor of the printer system by using the clock generated from the clock generating unit 1101. A position up/down counter 1110 performs counting operation to seek the present position of the printhead by using the clock divided from the position dividing unit 1109. A comparator 1111 compares the values stored in the software register 1108 with the count value from the position up/down counter 1110 to generate an actual head position. A head fire position HFP difference input unit 1112 receives the calculated head fire position HFP difference. A print start position register 1113 stores the input head fire position HFP difference. And a comparator 1114 compares the actual head position value from the comparator 1111 with the head fire position HFP difference stored in the print start position register 1113 to generate a print signal delayed as much as the head fire position HFP difference.

Enable signal generating unit B2 includes a resolution dividing unit 1115 for dividing the clock generated from the clock generating unit 1101 considering the proper printing resolution. A FTD counter 1116 performs counting operation based upon the clock divided by the resolution dividing unit 1115. A FTD difference input unit 1118 receives the calculated fire time delay FTD difference. A software delay register 1119 stores the input fire time delay FTD difference. And a comparator 1117 compares the value counted by the FTD counter 1116 with the fire time delay FTD difference stored in the software delay register 1119 to generate an enable signal by delaying the fire time.

Printing unit B3 includes a comparator 1106 for comparing the print start signal generated from the print start signal B1 with the enable signal generated from the enable signal generating unit B2, and a head driving unit 1107 for driving the printhead according to the signal outputted by the comparator 1106 to perform the printing delayed as much as the calculated mechanical error.

The alignment system for automatically controlling the bidirectional printing position of a printhead in a serial printer according to the principles of the present invention will now be described with reference to FIGS. 4A and 4B, FIG. 5 and FIG. 7 hereinbelow.

First, after the power supply of the printer system is turned on as shown in FIG. 4, an initial value of the printhead fire position HFP is set. After that, the printer system is initialized at step 401 in order to set the optical sensor 38 at an initial position ① as shown in FIG. 5, and a variable N is initialized for beginning counting the number of aligning times of the vertical line to zero (0).

After the printer system is initialized, the CPU receives user request for vertical alignment of the carriage supporting the printhead for performing a vertical alignment operation at step 402. Here, the user can either operate an option key of the printer directly or set the printer in such a way that the vertical alignment can be automatically executed when the printer system is initialized.

After the request for vertical alignment from the user is received, the carriage 32 supporting an optical sensor 38 as shown in FIG. 3 is moved toward the optical receptor 39 attached to the main frame 31 in direction F2 as shown in FIG. 5 at step 403 so that the optical receptor 39 can sense the position of the carriage 32. As the carriage 32 moves toward the optical receptor at step 403, the CPU determines whether a head fire position HFP of the carriage 32 supporting the optical emitter 38 is at the first adjacent position 56 F3 as shown in FIG. 5 at step 404.

If the head fire position HFP of the carriage 32 supporting the optical emitter 38 is not at the first adjacent position 56 F3 as shown in FIG. 5 at step 404, the carriage 32 is moved continuously toward the optical receptor 39 until the head fire position HFP of the carriage 32 is at the first adjacent position. If, on the other hand, the head fire position HFP of the carriage :32 supporting the optical emitter 38 is at the first adjacent position 56 F3 as shown in FIG. 5 at step 404, the CPU initializes the fire time delay FTD counter and start the operation of the counter at step 405. At this time, when the fire time delay FTD count is stored from the position 0 of the head fire position HFP, a large amount of memory is needed as data being stored in the memory is increased. Thus, when operating the fire time delay FTD counter after being arrived at the position adjacent to the standard position, the memory requirement can be minimized.

After the FTD counter is initialized for counter operation at step 405, the CPU determines whether the head fire position HFP value is increased at step 406. When the head fire position HFP value is increased by a constant, for example, one (1) as a result of the counter operation at step 406, the CPU again initializes the fire time delay FTD counter and start the operation of the counter at step 405. If, on the other hand, the head fire position HFP value is not increased by one (1) as a result of the counter operation at step 406, the CPU determines whether an optical light transmitted from the optical sensor 38 is sensed by the optical receptor 39 at step 407. Here, when the optical light transmitted from the optical sensor is not sensed by the optical receptor 39, the CPU returns to step 406 to determine whether the head fire position HFP value is increased by one (1). However, in the case that the optical light transmitted from the optical emitter 38 is sensed by the optical receptor 39 at position F4 as shown in FIG. 5, (that is, the first sensor signal sensing position 75 of FIG. 7), the CPU stores the present value $N\phi_{+2}$ of the head fire position HFP and the fire time delay FTD count value 6 in a first register at step 408.

After the present values of the head fire position HFP and the fire time delay FTD count are stored at step 408, the CPU determines whether the present position of the carriage 32, i.e., the head fire position HFP is at a return position as the carriage is continuously moved to position F5 at step 409. If the head fire position HFP is at the return position, the carriage 32 is moved inversely, that is, in a reverse direction at step 410.

Next, the CPU determines whether the head fire position HFP of the carriage 32 supporting the optical sensor 38 is at a second adjacent position F6 as shown in FIG. 5 at step 411. When the head fire position HFP of the carriage 32 supporting the optical emitter 38 is not at the second adjacent position, the carriage 32 is moved continuously until the head fue position HFP is at the second adjacent position. When the head fire position HFP of the carriage 32 supporting the optical sensor 38 is at the second adjacent position 2, however, the CPU initializes the fire time delay FTD counter and starts the operation of the counter at step 412.

After the FTD counter is initialized for counter operation at step 412, the CPU determines whether the head fire position HFP value is increased at step 413. When the head fire position HFP value is increased by a constant, for example, one (1) as a result of the counter operation at step 412, the CPU again initializes the fire time delay FTD counter and start the operation of the counter at step 412. If, on the other hand, the head fire position HFP value is not increased by one (1) as a result of the counter operation at step 406, the CPU determines whether an optical light transmitted from the optical sensor 38 is sensed by the optical receptor 39 at step 414. Here, when the optical light transmitted from the optical sensor is not sensed by the optical receptor 39, the CPU returns to step 413 to determine whether the head fire position HFP value is increased by one (1). However, in the case that the optical light transmitted from the optical emitter 38 is sensed by the optical receptor 39 at position F7 as shown in FIG. 5, (that is, the second sensor signal sensing position 76 of FIG. 7), the CPU stores the present value Nϕ of the head fire position HFP and the fire time delay FTD count value 5 in a second register at step 415.

After the present values of the head fire position HFP and the fire time delay FTD count are stored at step 415, the CPU determines whether the present position of the carriage 32, i.e., the head fire position HFP is at a start position as the carriage is continuously moved to position F8 at step 416. If the head fire position HFP is at the start position, the movement of the carriage 32 is stopped at step 417.

After the carriage 32 is stopped at step 417, the position difference 77 generated by mechanical error shown in FIG. 7 is calculated using the values stored in the first register and second register. Thereafter, the CPU determines whether the position difference (that is, the head fire position 2 and the standard clock 1) value is within an allowable error range at step 419. At this time, the allowable error is used to prevent the error between the actual position difference caused by the other mechanical problem and the position difference calculated. Moreover, the allowable error range can be set by the manufacturer or by the user using an option key.

When the position difference value, that is, the difference between the head fire position HFP and the fire time delay FTD is within the allowable error range, the CPU inputs the head fire position HFP difference in the print start position register 1113 via the HFP difference input unit 1112, and the fire time delay FTD difference in the software delay register 1119 via the FTD difference input unit 1118. After the head fire position HFP difference is stored in the print start position register 1113 and the fire time delay FTD difference is stored in the software delay register 1119, the CPU confirms the aligned vertical line print position at step 421, and then the vertical alignment operation is completed.

On the other hand, when the head fire position HFP difference and the fire time delay FTD difference are beyond the allowable error range as a result of the allowable error determination, the CPU determines the number of control times for performing the control operation up to 3 times. If the number of the vertical line aligning times is less than 3, the vertical alignment operation is performed again starting from step 403. When the number is larger than 3, however, an error occurs.

The process for calculating the mechanical error according to the present invention will now be described with reference to FIGS. 9 and 10 as follows.

Figure 9:
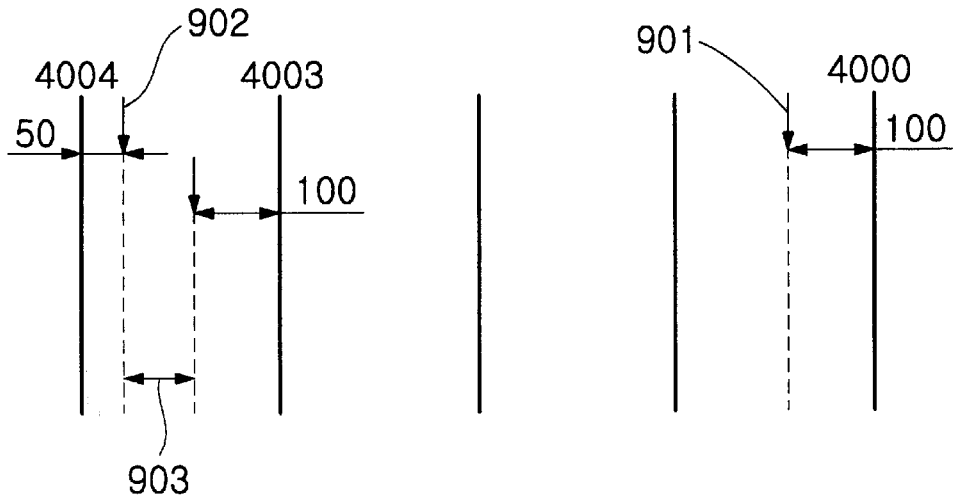
FIG. 9 is a conceptive diagram of two optical sensor signal positions provided in an embodiment of the present invention.
Figure 10:
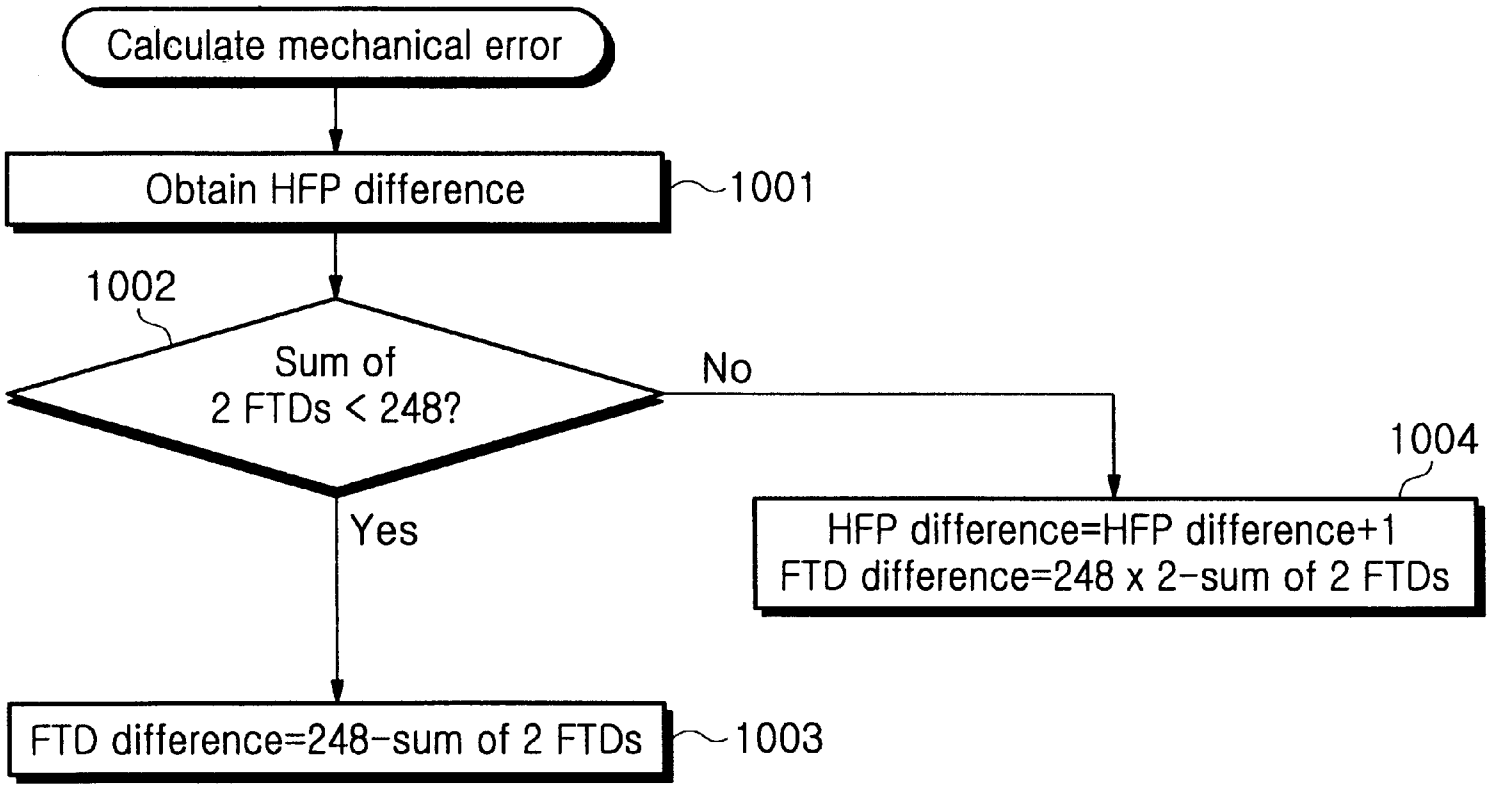
FIG. 10 illustrates a process of calculating a mechanical error using an embodiment of FIG. 9.

Referring to FIG. 9, when a position 901 where the first sensor signal is sensed is 4000HFP+100FTD and a position 902 where the second sensor signal is sensed is 4004HFP+50FTD, the mechanical error is obtained by a process as shown in FIG. 10.

First, the head fire position HFP difference is obtained at step 1001, that is, 3 is obtained by the difference of 4004−4000−1. After the head fire position HFP difference is obtained, the CPU determines whether the sum of the fire time delay FTD of the first and second sensor signal sensing positions is less than 248 at step 1002, that is, 100+50 is compared with 248.

When the sum of the fire time delay FTD of the two sensor signal sensing positions is larger than 248 as a result of such determination, the head fire position HFP difference is increased by 1, and the fire time delay FTD difference is obtained by extracting the sum of the fire time delay FTD of the two positions from 248×2 at step 1004. If, on the other hand, the sum of the fire time delay FTD of the two positions is smaller than 248, the fire time delay FTD difference is obtained by extracting the sum of the fire time delay FTD of the two positions from 248 at step 1003.

The operation for controlling the print position of a printhead using the value of the mechanical error calculated is now described as follows.

Referring to FIG. 11, the comparator 1105 generates a clock pulse of $10/32 \times 1/62$ MHz (198.4 μs) by dividing the head fire standard clock according to the clock which clock pulse of 10 MHz (0.1 μs) generated from the clock generating unit 1101 is divided into 32 via the DPI dividing unit 1102, the head time dividing unit 1103 and the head time counter 1104, and according to the function of the printhead stored in the software register 1108.

The position up/down counter 1110 performs the counting operation by dividing the clock pulse of 10 MHz (0.1 μs) generated by the clock generating unit 1101 into 32 by the position dividing unit 1109. The head fire standard clock which is divided into 32×62 by the comparator 1111 is generated, according to the function of the printhead stored in the software register 1108.

The HFP difference is stored in the print start position register 1113 via the HFP difference input unit, and the value output from the comparator 1111 and the value stored in the print start position register 1113 are compared in the comparator 1114 in order to generate a fire start signal. That is, the printing operation is delayed as much as the head fire position value stored in the print start position register 1113. The clock pulse of 10 MHz, i.e., 0.1 μs generated from the clock generating unit 1101 is divided into 8 by the resolution dividing unit 1115, and the FTD counter 1116 starts the counting operation.

Additionally, the enable signal is generated by comparing the value of the FTD difference stored in the software delay register 1119 via the FTD difference input unit 1118 with the value of the FTD counter 1116. That is, the printing operation is delayed as much as the value of the fire delay time stored in the software delay register 1119. After comparing the value of the head fire standard clock generated by the comparator 1105, the fire start signal generated by the comparator 1114, and the enable signal generated by the comparator 1117, the head driving unit 1107 is driven and the printing operation is performed.

As described above, since the vertical alignment operation according to the present invention is dependent upon the stability of the sensor and the accuracy of the clock signal, the accuracy in setting the print position of the printhead is realized and the printing quality is enhanced. As the alignment operation is performed by the printer system instead of the user's visual confirmation, a control operation can be quickly performed and high productivity can be realized. Additionally, in the case that the printing condition of the vertical lines is changed when using the printer system, a setting order button can be pressed and the default is always used when starting the operation of the system.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A bidirectional print position alignment system for automatically controlling bidirectional printing position of a printhead in a serial printer having a movable cartridge and a main frame, said system comprising:

a sensing section for sensing a position of a printhead for vertical alignment;

a misalignment detecting section for detecting mechanical misalignment of the printhead; and a printing section for correcting said mechanical misalignment of the printhead, and printing information on a printable medium after said mechanical misalignment of the printhead is corrected;

further comprised of said sensing section including an optical emitter for transmitting an optical signal and an optical receptor for sensing the optical signal transmitted from said optical emitter, one of said optical emitter and optical receptor being mechanically coupled to said printhead and the other of said optical emitter and optical receptor being mechanically coupled to said main frame; and said misalignment detecting section comprising:

a transport unit for moving and stopping movement of said carriage bidirectionally in a print axis;

a first processing unit for storing a head fire position HFP where said optical signal is first sensed by said optical receptor as said carriage moves in a first direction, and storing a fire time delay count FTD value;

a second processing unit for storing a head fire position HFP where said optically signal is secondly sensed by said optical receptor as said carriage moves in a second direction opposite from said first direction, and storing a fire time delay count FTD value; and a position difference determining unit for determining a value of the position difference of said printhead sensed by said sensing section.

2. The bidirectional print position alignment system of claim 1, further comprised of said first processing unit comprising:

an adjacent position determination unit for determining whether said carriage is arrived at the head fire position HFP corresponding to a first adjacent position;

a counter operating unit for initializing a fire time delay FTD counter when said carriage is arrived at said first adjacent position and starting operation of the fire time delay FTD counter;

a head fire position increase determination unit for determining whether a count value of said fire time delay FTD counter exceeds a head fire position HFP value;

a sensing determination unit for determining whether said optical signal is sensed by said optical receptor when the head fire position HFP value is not increased as a result of said head fire position value increase determination; and a storing unit for storing said head fire position HFP where said optical signal is sensed when said optical signal is sensed by said optical receptor as a result of said sensing determination, and for storing said fire time delay FTD count.

3. The bidirectional print position alignment system of claim 1, further comprised of said transport unit comprising:

a return position determination unit for determining whether said carriage is arrived at the head fire position HFP corresponding to a return position; and a moving unit for moving said carriage reversely when said carriage is arrived at the return position as a result of the return position determination.

4. The bidirectional print position alignment system of claim 3, further comprised of said transport unit including:

a start position determining unit for determining whether said carriage is arrived at the head fire position HFP; and a stopping unit for stopping said carriage when said carriage is arrived at the start position as a result of the start position determination.

5. The bidirectional print position alignment system of claim 1, further comprised of said second processing unit including:

an adjacent position determination unit for determining whether said carriage is arrived at the head fire position HFP corresponding to a second adjacent position;

a counter operating unit for initializing a fire time delay FTD counter when said carriage is arrived at the second adjacent position as a result of the adjacent position determination and starting operation of the fire time delay FTD counter;

a head fire position HFP value increase determination unit for determining whether the value of said fire time delay FTD counter exceeds the head fire position HFP value;

a sensing determination unit for determining whether said optical signal is sensed by said optical receptor when said fire position value is not increased as a result of said head fire position HFP value increase determination; and a storing unit for storing said head fire position HFP where said optical signal is sensed by said optical receptor, and storing the said fire time delay FTD count.

6. The bidirectional print position alignment system of claim 1, further comprised of said position difference operating unit obtaining the head fire position HFP difference and the fire time delay FTD difference using the position values of said printhead.

7. The bidirectional print position alignment system of claim 6, further comprised of said printing section including:

a clock generating unit for generating a clock signal to adjust the synchronism of the serial printer;

a print start signal generating unit for generating a print start signal by determining a print position in compliance with the head fire position HFP value calculated using the clock signal;

an enable signal generating unit for generating an enable signal by determining a print time upon a predetermined printing position in compliance with the difference of the fire time delay FTD calculated using the clock signal; and a printing unit for performing printing operation delayed as much as a mechanical error value obtained from comparing said print start signal with said enable signal.

8. The bidirectional print position alignment system of claim 7, further comprised of said print start signal generating unit comprising:

a DPI divider for dividing the clock signal according to a dot per inch supported by the serial printer;

a head time divider for dividing again the clock signal divided from the DPI divider to generate a standard clock frequency per one nozzle;

a head time counter for counting a head time based on the clock signal divided from the position divider;

a software register for registering information on the function of said printhead;

a first comparator for generating a head fire standard clock by comparing the value counted by said head time counter with the value stored in said software register;

a resolution divider for dividing the clock signal to generate a control clock signal for controlling operation of a motor in the serial printer;

a position up/down counter for performing the counting operation to seek the present position of the printhead by using the clock signal divided from said position divider;

a second comparator for detecting an actual head position by using the value stored in said software register;

a HFP difference input unit for receiving the difference of the head fire position HFP;

a print start position register for storing the input head fire position HFP difference; and a third comparator for generating the print signal delayed as much as the head fire position HFP difference by comparing the value of the actual head position located by said second comparator with the head fire position HFP difference stored in said print start position register.

9. The bidirectional print position alignment system of claim 8, further comprised of said enable signal generating unit including:

a resolution divider for dividing the clock signal for proper printing resolution;

a fire time delay FTD counter for counting the clock signal divided from the resolution divider;

a fire time delay FTD difference input unit for receiving said head time delay FTD difference;

a software delay register for storing the input fire time delay FTD difference; and a fourth comparator for generating an enable signal by delaying the fire time as much as the fire time delay FTD difference stored in said software delay register by using the value counted by said FTD counter.

10. The bidirectional print position alignment system of claim 9, further comprised of said printing unit including:

a fifth comparator for comparing the print start signal with the enable signal to produce a print control signal; and a head driver for driving the printhead according to the print control signal to perform the printing operation delayed as much as the mechanical error.

11. A bidirectional print position alignment system for automatically controlling bidirectional printing position of a printhead in a serial printer having a movable cartridge and a main frame, said system comprising:

a sensing section, including an optical emitter and an optical receptor, for sensing a position of a printhead for vertical alignment, one of said optical emitter and optical receptor being mechanically coupled to said printhead and the other of said optical emitter and optical receptor being mechanically coupled to said main frame;

a misalignment detecting section for detecting mechanical misalignment of the printhead; and a printing section for correcting said mechanical misalignment of the printhead, and printing information on a printable medium after said mechanical misalignment of the printhead is corrected;

further comprised of said printing section including:

a clock generating unit for generating a clock signal to adjust the synchronism of the serial printer;

a print start signal generating unit for generating a print start signal by determining a print position in compliance with the head fire position HFP value calculated using the clock signal;

an enable signal generating unit for generating an enable signal by determining a print time upon a predetermined printing position in compliance with the difference of the fire time delay FTD calculated using the clock signal; and a printing unit for performing printing operation delayed as much as a mechanical error value obtained from comparing said print start signal with said enable signal.

12. A method for automatically controlling bidirectional printing of a printhead in a serial printer including a sensing unit for directly sensing a position of a printhead with respect to a fixed reference frame for vertical alignment, a misalignment detecting unit for detecting mechanical misalignment of the printhead, and a printing unit for printing information on a printable medium after said mechanical misalignment of the printhead is corrected, said method comprising the steps of:

moving said printhead in a first direction;

storing, in a first processing operation, a head fire position HFP where said printhead is first directly sensed by said sensing unit and storing a fire time delay FTD count;

moving said printhead a second direction opposite of said first direction;

storing, in a second processing operation, the head fire position HFP where said printhead is secondly directly sensed by said sensing unit and storing the fire time delay FTD count;

stopping movement of said printhead;

determining a value of position difference of said printhead sensed by said sensing unit; and shifting said printhead in accordance with the value of position difference for alignment of the printhead.

13. The method of claim 12, wherein said first processing operation includes:

determining whether said printhead is arrived at the head fire position HFP corresponding to a first adjacent position;

initializing a fire time delay FTD counter when said printhead is arrived at said first adjacent position and starting operation of the fire time delay FTD counter;

determining whether the head fire position HFP value is increased by a constant;

repeating the initialization of the fire time delay FTD counter when said head fire position HFP value is increased by said constant;

determining whether said printhead is sensed by said sensing unit when the head fire position HFP value is not increased by said constant;

repeating the determination of whether the head fire position HFP value is increased by a constant, when said printhead is not sensed by said sensing unit; and storing the head fire position HFP value when said printhead is sensed by said sensing unit and storing the fire time delay FTD count.

14. The method of claim 12, wherein said step of moving said printhead a second direction opposite of said first direction includes:

determining whether said printhead is arrived at the head fire position HFP corresponding to a return position; and moving said printhead in said second direction when said printhead is arrived at the return position.

15. The method of claim 12, wherein said second processing operation further comprises:

determining whether said printhead is arrived at the head fire position HFP corresponding to a second adjacent position;

initializing a fire time delay FTD counter when said printhead is arrived at said second adjacent position and starting operation of the fire time delay FTD counter;

determining whether the head fire position HFP value is increased by a constant;

repeating the initialization of the fire time delay FTD counter when said head fire position HFP value is increased by said constant;

determining whether said printhead is sensed by said sensing unit when the head fire position HFP value is not increased by said constant;

repeating the determination of whether the head fire position HFP value is increased by a constant, when said printhead is not sensed by said sensing unit; and storing the head fire position HFP value when said printhead is sensed by said sensing unit and storing the fire time delay FTD count.

16. The method of claim 12, wherein said step of stopping movement of said printhead comprises:

determining whether said printhead is arrived at the head fire position HFP corresponding to a start position; and stopping the movement of said printhead when said printhead is arrived at the start position.

17. The method of claim 12, wherein said step of shifting said printhead for alignment comprises:

determining whether the head fire position FHP difference and the fire time delay FTD difference are within an allowable error range;

shifting said printhead for alignment using the value of position difference as a compensating value when the head fire position FHP difference and the fire time delay FTD difference are within the allowable error range; and testing the print position of the printhead with printed materials.

* * * * *